US005181487A

United States Patent [19]

Rodabaugh

[11] Patent Number: 5,181,487

[45] Date of Patent: Jan. 26, 1993

[54] SPLIT OIL PAN CONSTRUCTION

[76] Inventor: Timothy E. Rodabaugh, 9515 Culberson, Dallas, Tex. 75227

[21] Appl. No.: 842,270

[22] Filed: Feb. 27, 1992

[51] Int. Cl.[5] ..... F16N 31/00

[52] U.S. Cl. ..... 123/195 C; 123/198 E; 184/106; 184/1.5

[58] Field of Search ..... 123/195 C, 198 E, 196 R; 184/1.5, 106

[56] References Cited

U.S. PATENT DOCUMENTS

| | | | |
|---|---|---|---|
| 2,577,188 | 12/1951 | Hall | 184/106 |
| 2,618,351 | 11/1952 | Giacosa | 123/196 R |
| 3,724,599 | 4/1973 | Heidacker | 123/195 C |
| 4,068,646 | 1/1978 | Hnojsky | 123/195 C |
| 4,457,274 | 7/1984 | Gottlob | 184/106 |
| 4,674,455 | 6/1987 | Tsuboi | 123/195 C |

*Primary Examiner*—E. Rollins Cross
*Assistant Examiner*—Erick Solis
*Attorney, Agent, or Firm*—Leon Gilden

[57] ABSTRACT

A split oil pan is arranged for permitting removal of a rear sump portion relative to a front sump portion to accommodate access interiorly of a crank case of an associated internal combustion engine. The oil pan includes a rear sump portion forward flange cooperative with a forward sump portion rear flange securable together by use of a fastening pan member.

3 Claims, 4 Drawing Sheets

SPLIT OIL PAN CONSTRUCTION

BACKGROUND OF THE INVENTION

1. Field of the Invention

The field of invention relates to oil pan apparatus, and more particularly pertains to a new and improved split oil pan construction wherein the same permits selective removal of a rear pan member relative to a forward pan member.

2. Description of the Prior Art

Geometric clearances, as well as ease of servicing of various components within internal combustion engines, are required in removal of the associated oil pan and is mandated thereby. Due to various components such as cross members, road height, and the like, removal of the oil pan is at times difficult without removal of the complete automotive engine. The instant invention attempts to overcome deficiencies of the prior art by providing a new and improved split oil pan construction arranged to permit removal of a rear pan portion relative to the forward pan portion for servicing of various components such as an oil pump, a rear main seal, and the like within an internal combustion engine.

Various oil pump constructions have been available in the prior art to accommodate various conditions, but have heretofore not addressed the unique construction of the instant invention. Such oil pan members are set forth in the U.S. Pat. Nos. 3,425,514; 4,848,293; 4,930,469; 4,825,825; and 3,805,920.

Accordingly, it may be appreciated that there continues to be a need for a new and improved split oil pan construction as set forth by the instant invention which addresses both the problems of ease of use as well as effectiveness in construction to permit selective separation of an oil pan member while mounted to an internal combustion engine and in this respect, the present invention substantially fulfills this need.

SUMMARY OF THE INVENTION

In view of the foregoing disadvantages inherent in the known types of oil pan construction now present in the prior art, the present invention provides a split oil pan construction wherein the same permits selective removal of a rear oil pan member relative to a forward oil pan member. As such, the general purpose of the present invention, which will be described subsequently in greater detail, is to provide a new and improved split oil pan construction which has all the advantages of the prior art oil pan member constructions and none of the disadvantages.

To attain this, the present invention provides a split oil pan arranged for permitting removal of a rear sump portion relative to a front sump portion to accommodate access interiorly of a crank case of an associated internal combustion engine. The oil pan includes a rear sump portion forward flange cooperative with a forward sump portion rear flange securable together by use of a fastening pan member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved split oil pan construction which has all the advantages of the prior art oil pan constructions and none of the disadvantages.

It is another object of the present invention to provide a new and improved split oil pan construction which may be easily and efficiently manufactured and marketed.

It is a further object of the present invention to provide a new and improved split oil pan construction which is of a durable and reliable construction.

An even further object of the present invention is to provide a new and improved split oil pan construction which is susceptible of a low cost of manufacture with regard to both materials and labor, and which accordingly is then susceptible of low prices of sale to the consuming public, thereby making such split oil pan constructions economically available to the buying public.

Still yet another object of the present invention is to provide a new and improved split oil pan construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
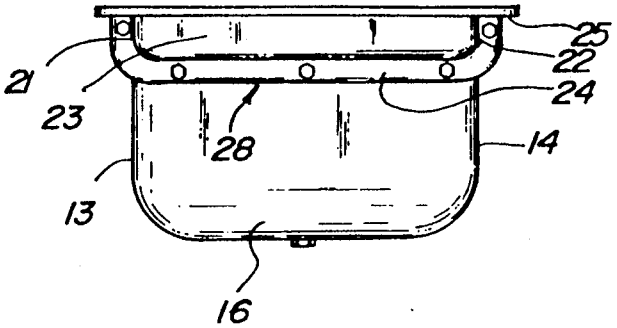
FIG. 2 is an orthographic frontal end view of the invention.
Figure 1:
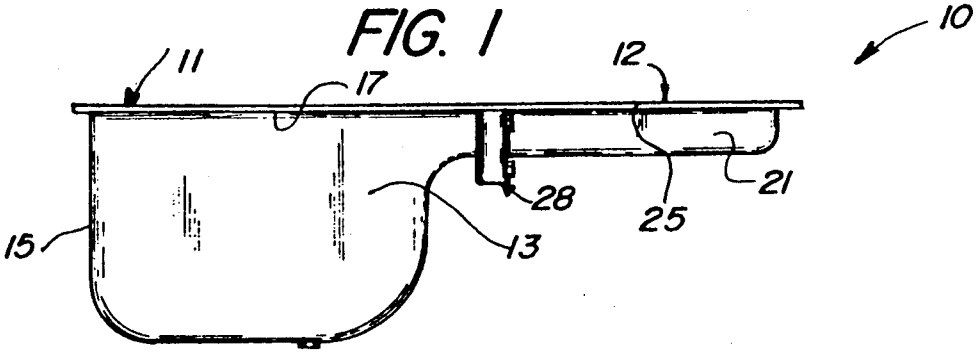
FIG. 1 is an orthographic side view of the instant invention.
Figure 3:
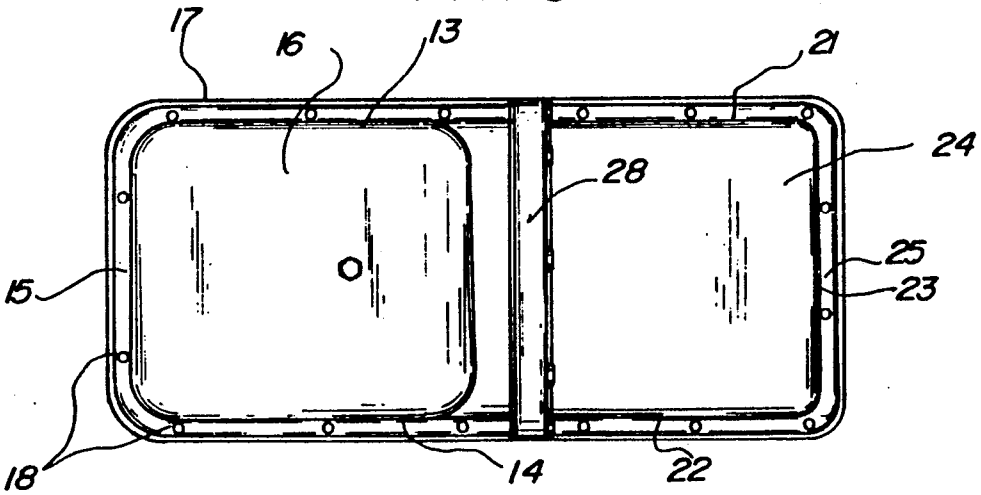
FIG. 3 is an orthographic bottom view of the invention.
Figure 4:
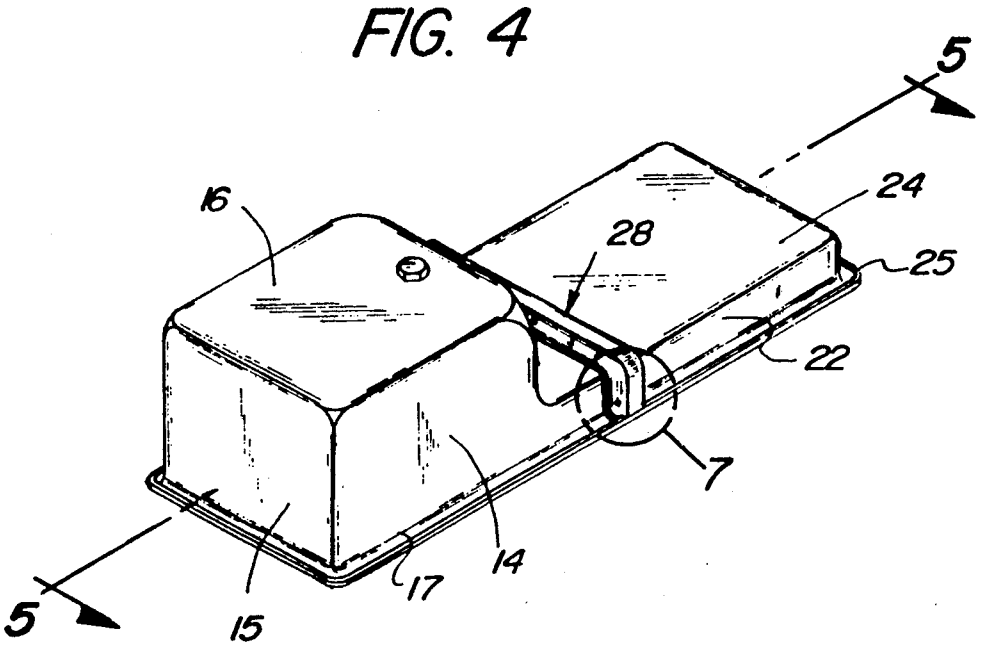
FIG. 4 is an isometric illustration of the invention.

With reference now to the drawings, and in particular to FIGS. 1 to 9 thereof, a new and improved split oil pan construction embodying the principles and concepts of the present invention and generally designated by the reference numeral 10 will be described.

More specifically, the split oil pan construction 10 of the instant invention essentially comprises a rear pan member 11 selectively securable to a forward pan member 12. The rear pan member includes a rear pan right side wall 13 spaced from a rear pan left side wall 14. A rear pan rear wall 15 defines a continuous U-shaped side wall of the rear pan member 11. A rear pan floor 16 is fixedly secured to the lower distal ends of the rear pan side walls extending forwardly to a rear pan securement flange 19 that is integral with, coextensive to, and orthogonally oriented relative to the forward distal end of the floor 16 and the right and left side walls 13 and 14. A mounting flange 17 of a generally U-shaped configuration is mounted to the upper distal ends of the rear pan side walls 13, 14, and 15. The rear pan securement flange 19 includes a plurality of rear pan securement flange apertures directed therethrough.

The forward pan member 12 includes a forward pan right side wall 21 arranged coplanar with the rear pan right side wall 13. A forward pan left side wall 22 is arranged coplanar and projecting forwardly of the rear pan left side wall 14, with a forward pan forward wall 23 spaced from the rear pan securement flange 19 and an associated forward pan securement flange 26 orthogonally oriented relative to the rear distal ends of the forward pan right side wall 21, left side wall 22, and the floor 24. The forward pan securement flange 26 includes a plurality of forward pan apertures 27, with one of the apertures 27 aligned with one of the rear pan apertures 20. A forward pan mounting flange 25 of a U-shaped configuration is arranged coplanar with the rear pan mounting flange 17.

Figure 5:
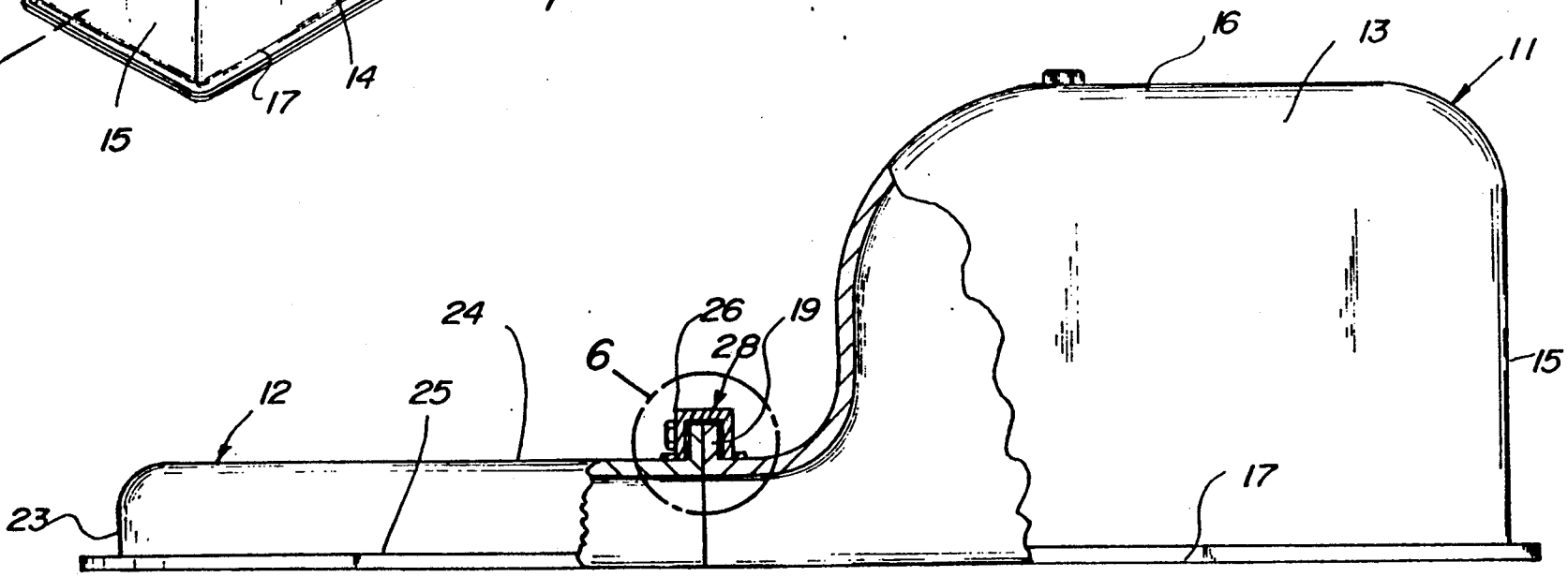
FIG. 5 is an enlarged orthographic side view, partially in section, of the invention.
Figure 7:
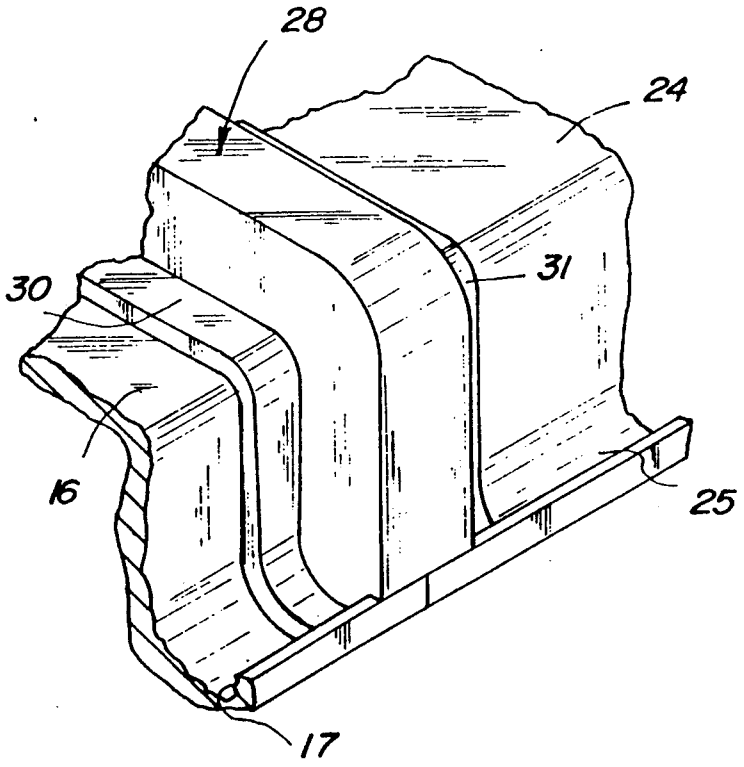
FIG. 7 is an isometric illustration of section 7, as set forth in FIG. 4.
Figure 6:
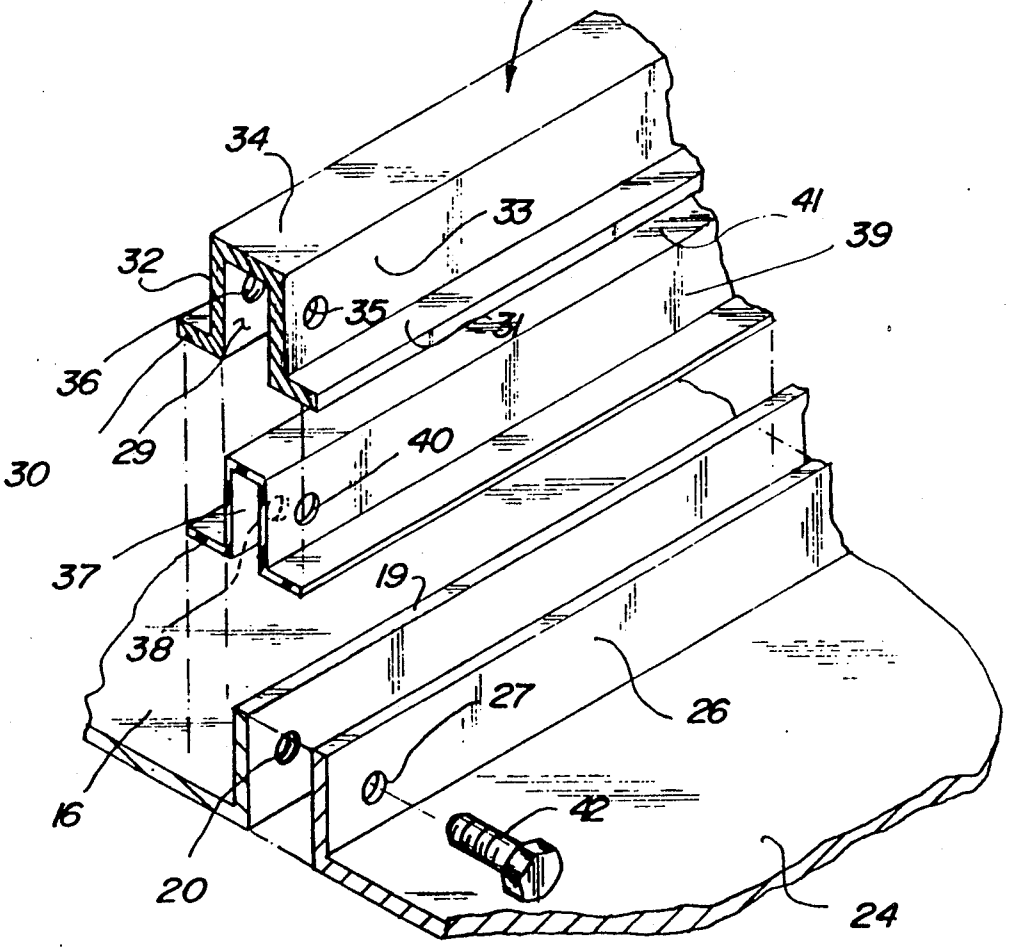
FIG. 6 is an isometric illustration of section 6, as set forth in FIG. 5.
Figure 9:
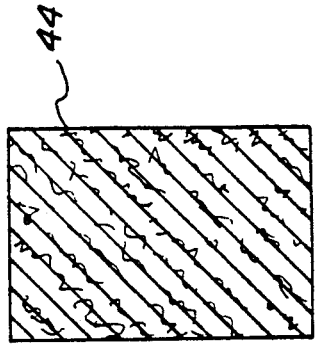
FIG. 9 is an orthographic view, taken along the lines 9—9 of FIG. 8 in the direction indicated by the arrows.

A fastener pan 28 defines an elongate trough 29 to receive the forward pan securement flange 26 and the rear pan securement flange 19 therewithin when the rear pan securement flange 19 and the forward pan securement flange 26 are in a contiguous coextensive relationship, in a manner as illustrated in FIG. 5 for example. The fastener pan 28 includes a fastener pan rear flange 30 and a fastener pan forward flange 31. The trough rear wall 32 is arranged parallel and coextensive with a trough forward wall 33, with a trough floor 34 extending coextensively and integrally mounted to upper distal ends of the trough rear and forward walls 32 and 33 to define the trough 29 therewithin. A sealing member, of a type such as illustrated in the FIG. 6, includes a sealer member rear wall 37, including sealer member rear wall bores 38 therethrough. A sealer member forward wall 39 includes a plurality of sealer member forward wall bores 40 directed therethrough, with a sealer member floor 41 arranged coextensively to the rear and forward walls 37 and 39. Externally threaded bolts 32 are threadedly received within the fastener pan rear wall threaded bores 36 that are coaxially aligned with the trough forward wall smooth bores 35, whereupon a fastener bolt 42 is directed through a rear pan securement flange aperture 20, a forward pan smooth bore aperture 27, through the sealer member rear wall bore 38 and the sealer member forward wall bore 40 to be subsequently threadedly received within the trough rear wall threaded bore 36. Accordingly, the bores 20, 27, 35, 36, 38, and 40 are coaxially aligned relative to one another in an assembled configuration of the organization.

Figure 8:
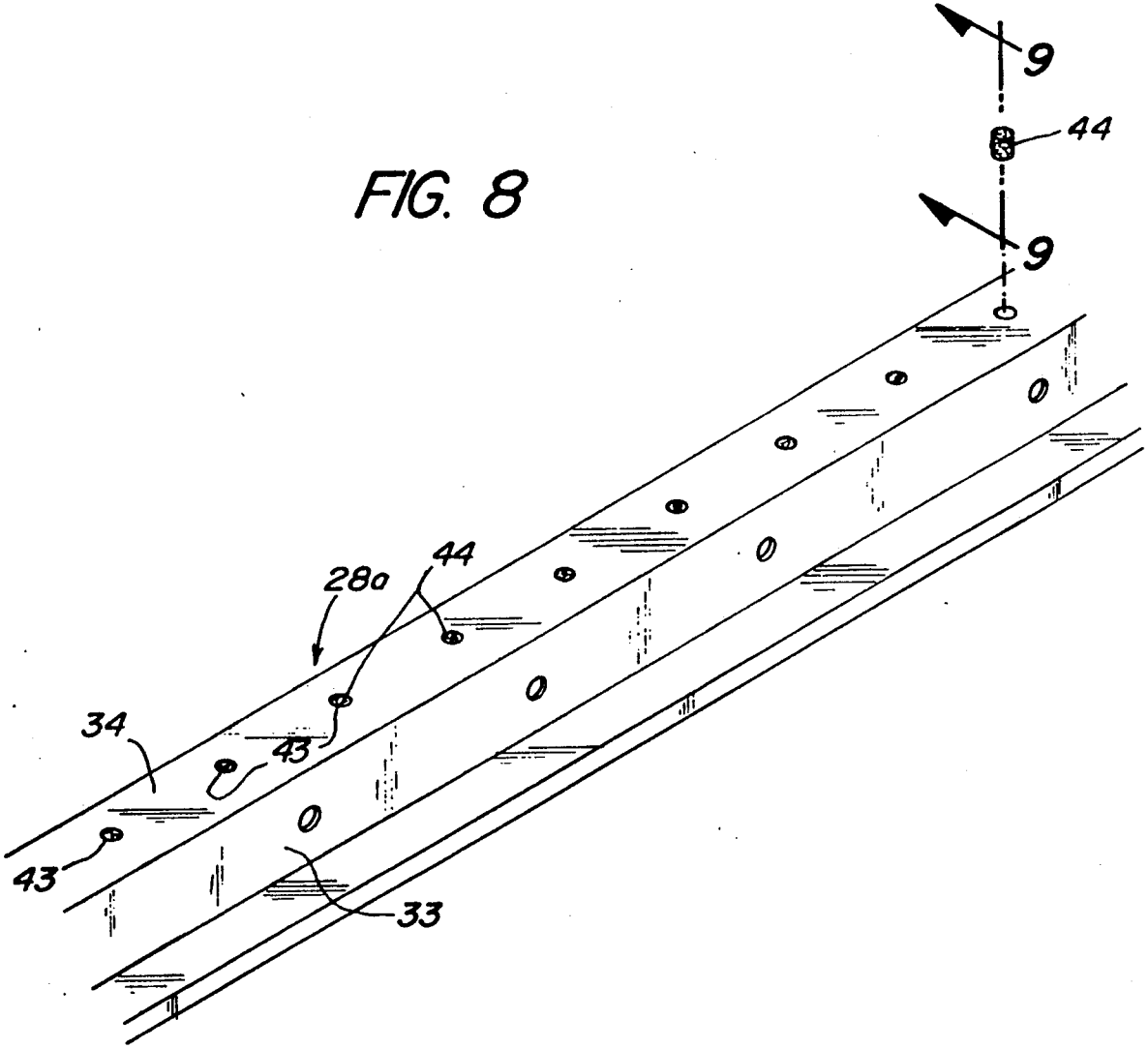
FIG. 8 is an isometric illustration of a modified fastener pin, as utilized by the invention.

The FIG. 8 includes a modified fastener pan 28*a*, including a series of spaced fastener pan floor bores 43 directed orthogonally into and through the floor 34, with each fastener pan floor bore 43 receiving a fibrous indicator cylinder 44 therewithin. Should there be leakage relative to the sealer member structure, the oil will seep into the indicator cylinders 44 to indicate improper sealing of the rear and forward pan members 11 and 12 together.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A split oil pan construction arranged for securement to an internal combustion engine, wherein the oil pan comprises, a rear pan member selectively securable to a forward pan member, the rear pan member including a rear pan right side wall spaced from a rear pan left side wall, and a rear pan rear side wall, and a floor extending from the rear pan rear side wall coextensively along the rear pan right side wall and the rear pan left side wall, with the rear pan right side wall, rear pan left side wall, and the rear pan floor terminating in a rear pan securement flange integral with, coextensive to, and orthogonally oriented relative to a forward distal end of the rear pan floor, rear pan left side wall, and the rear pan right side wall, and a U-shaped mounting flange integrally formed to each upper distal end of the rear pan right side wall, rear pan left side wall, and rear pan rear side wall, and the forward pan member including a forward pan right side wall spaced from a forward pan left side wall, and a forward pan forward wall, and a forward pan floor extending from the forward pan forward wall coextensively along the forward pan right side wall and the forward pan left side wall, and a forward pan mounting flange coplanar with the rear pan mounting flange, with the forward pan mounting flange of a generally U-shaped configuration formed to each upper distal end of the forward pan right side wall, forward pan left side wall, and forward pan forward wall, and a forward pan securement flange integrally and orthogonally mounted in a coextensive relationship relative to the forward pan right side wall, forward pan left side wall, and forward pan floor, and the forward pan securement flange is arranged for contiguous and coextensive abutment with the rear pan securement flange, and the rear pan securement flange includes a plurality of rear pan securement flange apertures, and the forward pan securement flange includes a plurality of forward pan securement flange apertures, with each rear pan securement flange aperture coaxially aligned with a forward pan securement flange aperture, and a fastener pan, the fastener pan including a fastener pan trough arranged to receive the rear pan securement flange and the forward pan securement flange therewithin, the fastener pan including a trough rear wall spaced from and parallel to a trough forward wall, and a trough floor extending coextensively along the trough rear wall and the trough forward wall, and a sealer member arranged for reception within the trough, with the sealer member receiving the rear pan securement flange and the forward pan securement flange therewithin.

2. An oil pan as set forth in claim 1 wherein the sealer member includes a sealer member rear wall spaced from a sealer member forward wall, the sealer member rear wall includes a plurality of sealer member rear wall bores, and the sealer member forward wall includes a plurality of sealer member forward wall bores, wherein the rear pan securement flange apertures, the forward pan securement flange apertures, trough forward wall bores, trough rear wall bores, the sealer member rear wall bores, and the sealer member forward wall bores are coaxially aligned relative to one another, and the trough rear wall bores are internally threaded, and a fastener member arranged to be received threadedly within each trough rear wall threaded bore to secure the fastener pan, the sealer member, the rear pan member, and the forward pan member together.

3. An oil pan as set forth in claim 2 wherein the trough floor includes a plurality of trough floor bores directed therethrough, and each trough floor bore includes a fibrous fluid absorbent indicator cylinder positioned therewithin.

* * * * *